United States Patent [19]

Greitzer

[11] Patent Number: 4,549,738

[45] Date of Patent: Oct. 29, 1985

[54] SWIVEL CHIP AND CARD DISPENSER FOR GAME BOARDS

[76] Inventor: Morris Greitzer, 3057 Earlmar Dr., Los Angeles, Calif. 90064

[21] Appl. No.: 605,169

[22] Filed: Apr. 30, 1984

[51] Int. Cl.[4] ..... A63F 1/10

[52] U.S. Cl. ..... 273/148 A; 211/58

[58] Field of Search ..... 273/148 A; 211/53, 56, 211/58

[56] References Cited

U.S. PATENT DOCUMENTS 1,184,196 5/1916 Michell ..... 273/148 A 3,185,482 5/1965 Russell ..... 273/148 A

*Primary Examiner*—Anton O. Oechsle

*Attorney, Agent, or Firm*—William H. Maxwell

[57] ABSTRACT

A chip and card dispenser for game tables, comprised of a manually rotatable platform wherein a swiveled arm turns on complementary hubs for support and adjusted clearance and predictable frictional engagement through a bearing at a determined radius and restricted contact area, and with a removable extension for manual engagement.

17 Claims, 7 Drawing Figures

SWIVEL CHIP AND CARD DISPENSER FOR GAME BOARDS

BACKGROUND

This invention relates to a particular card game known as "PAN" and more particularly as "Panguige", a well known card game that is played at a game table which is usually of substantial size due to the number of players involved and participating in the game. The game involves the distribution and drawing of the playing cards from a deck thereof, which must be readily accessible to the players. Accessibility of deck of playing cards to the players situated around the game table is the purpose herein, and it is a general object of this invention to improve upon the prior art turntable type devices that have previously been used.

Turntable devices and rotatable platforms of the type under consideration are usually comprised of a platform rotatable upon a base by means of an intervening circular row of ball bearings or the like. The platform and base are usually drawn together by a concentric draw pin, and the multiplicity of ball bearings are confined to operate in grooves of substantial radius from the centering pin. The prior art turntables of the aforesaid conventional construction are not altogether satisfactory, in that concentricity of the ball bearing grooves and of said grooves and centering pin is difficult to obtain if realized at all, to the end that these turntables are far from precision, and with the result that they are sloppy and noisy and do not run free, nor do they have predictable frictional characteristics. Quite often, the platform droops or sags. With the present invention, it is an object to provide a swivel dispenser of the fewest number of parts that are easily manufactured with precision and wherein concentricity is not a problem, and all to the end that a smooth and quiet operating rotatable device is provided with predictable frictional characteristics.

It is an object of this invention to provide a swivel dispenser of the type referred to, wherein the coefficient of friction between the rotating platform remains uniform with reference to the supporting base. Accordingly, the amount of force required in order to turn the device remains the same, and the braking effect is also consistent. Thus, the braking effect normally retains a stationary positioning of the platform at rest, while friction is predictably overcome when a player moves the deck of cards into a convenient position for his or her draw from the deck. In practice, plastic material is employed for the platform and base, one bearing upon the other at a uniform radius and area of engagement. The centering pin runs substantially friction free, with an initially adjusted axial thrust positioning that maintains a close rattle free fit between the platform and base.

Access across larger game tables is a problem, and to this end it is an object of this invention to facilitate access by extending a portion of the platform to be brought toward and into alignment with a player for drawing cards from the deck. Accordingly, the chip and card holder is provided with an extension which can be reached more readily by the players as they require access to the chips and to the card deck.

SUMMARY OF THE INVENTION

This invention is concerned with improving turntable type devices for use in card games where access to the deck of playing cards by successive players is to be facilitated. In practice, a chip and card holder is carred on a base for its alignment toward the player who is to draw from the deck. There is a platform centered upon the base, of substantial footing for stability, and there is uniform frictional engagement at a constant radius and contact area, for predictable movement and reliable braking. Prior art ball bearings are prone to accidently move from positioned rest, while the swivel dispenser of the present invention remains securely at rest. By fabricating the platform and base of plastic materials, a consistently predictable drag is established, whereby each player can rely upon easy access to the deck.

The foregoing and various other objects and features of this invention will be apparent and fully understood from the following detailed description of the typical preferred form and application thereof, throughout which description reference is made to the accompanying drawings.

FIG. 1 is a perspective view of the Swivel Chip And Card Dispenser For Game Boards, with a partial deck of cards and a number of chips shown carried thereby for access to the players.

FIGS. 2 and 3 are enlarged transverse sectional views taken as indicated by lines 2—2 and 3—3 on FIG. 1.

PREFERRED EMBODIMENT

Figure 1:
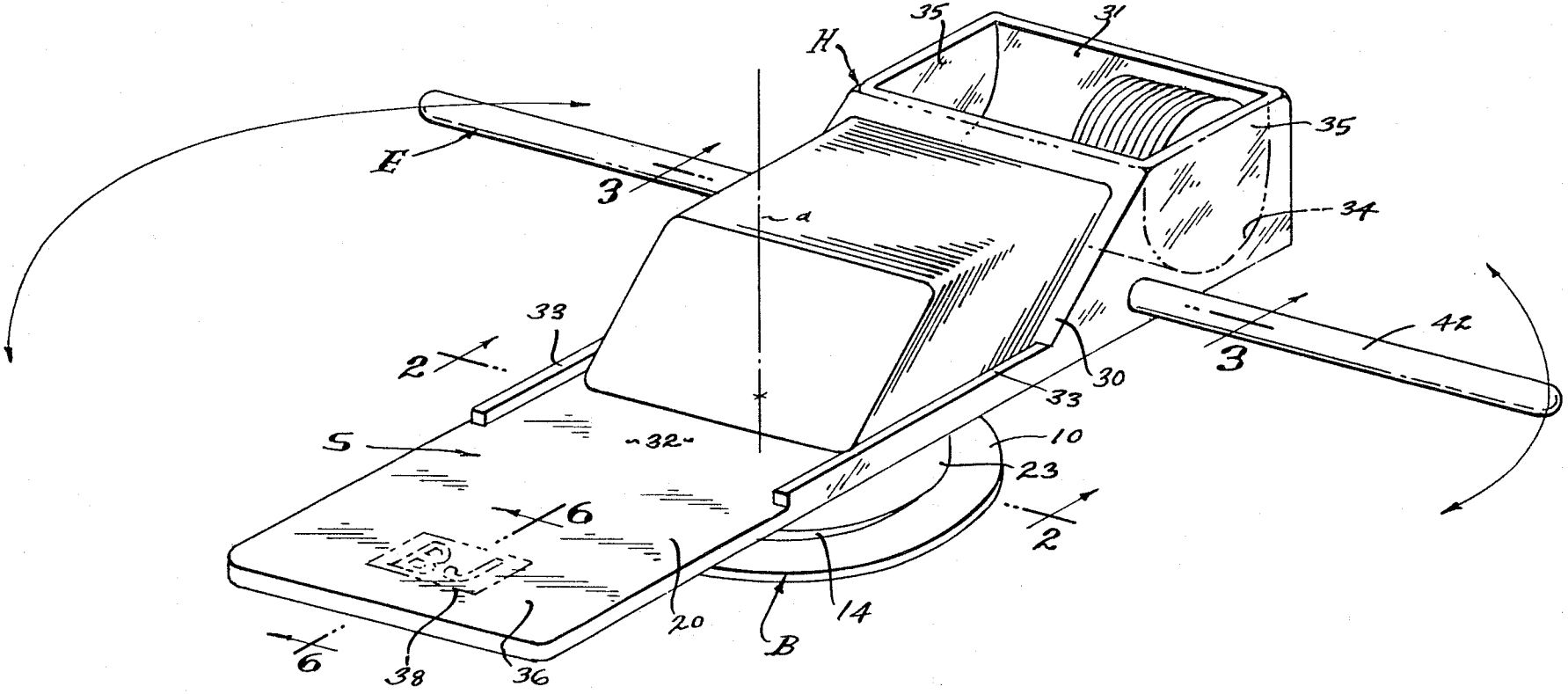
Figure 2:
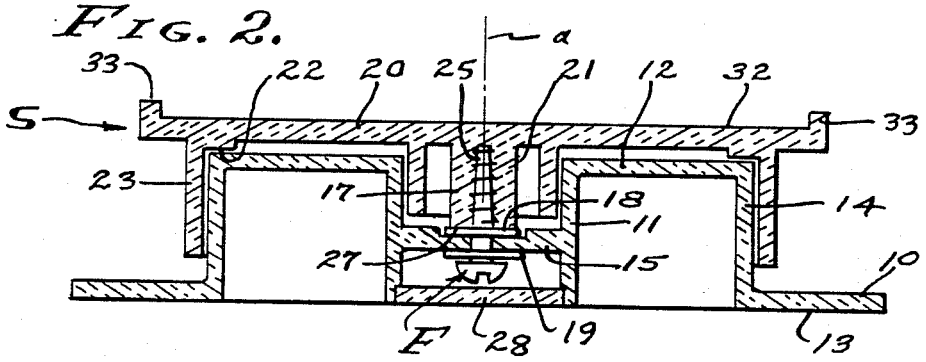
Figure 3:
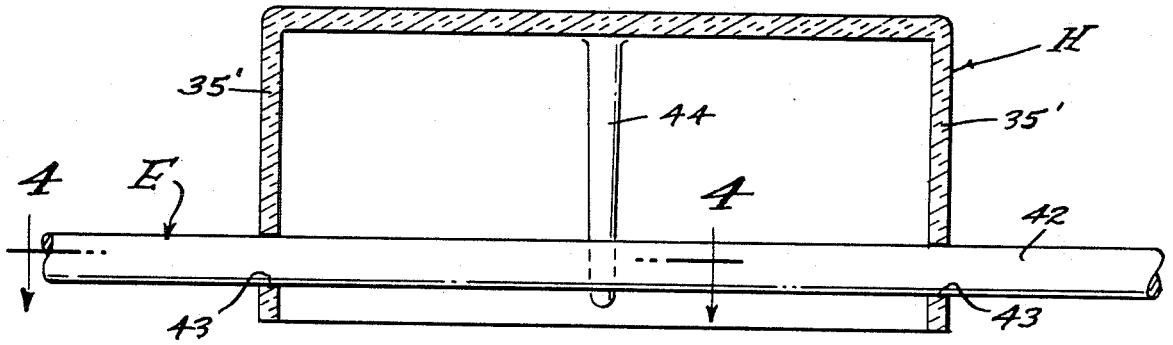
Figure 4:
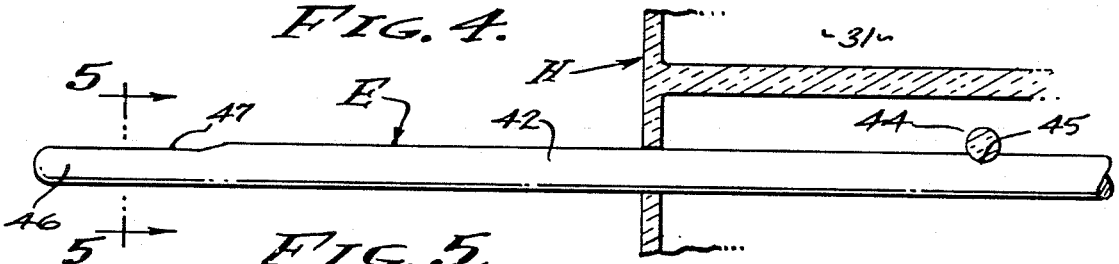
FIG. 4 is a fragmentary plan sectional view taken as indicated by line 4—4 on FIG. 3.
Figure 5:
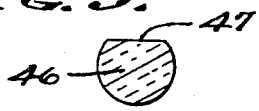
FIG. 5 is an enlarged detailed sectional view taken as indicated by line 5—5 on FIG. 4.
Figure 6:
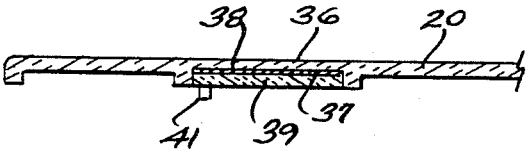
FIG. 6 is a fragmentary sectional view taken as indicated by line 6—6 on FIG. 1, showing a removable closure for capturing an identification card.

Referring now to the drawings, this Swivel Dispenser is for the selective dissemination of game chips and playing cards, and particularly for use in the game of PAN. As shown, the dispenser is comprised of two members, a base member B and a platform or swivel member S that is rotatable upon the base member. In practice, these two members B and S are simultaneously made of plastic by injection molding, or the like, including an extension E and certain other related parts, as later described.

The base member B provides the footing that supports the swivel member S for manipulation as may be required. As shown, the base member B includes a supporting flange 10 disposed concentrically about a vertical turning axis a, a supporting hub 11, and an upwardly disposed support bearing face 12 of circular form surrounding the hub joining the flange 10 and hub 11, and all of which are integrally formed. The supporting flange 10 has a flat horizontal bottom 13 for interface engagement with a table top, while the support bearing face 12 is spaced above the flange 10 and parallel thereto, carrying the centered supporting hub 11 which depends therefrom to terminate at the plane of bottom 13. A cylindrical wall 14 concentric with the axis a elevates the support bearing 12, at a diameter substantially the same as the width of the swivel arm later described. The supporting hub 11 is of open cylinder configuration divided by a partition wall 15 having a centered fastener opening, and presenting an upward open chamber for receiving the centering pivot 17 of the swivel member S and presenting a downward opening chamber for enclosing the fastener means F which secures the members B and S together in working relationship. As shown, the partition wall 15 is recessed for centering an axial spacer and thrust washer 18. The diameter of the recess is shallow and of relatively small diameter and therefore easily established as an accurate locator for the centering thrust washer 18.

The platform or swivel member S is the accessible element of the device that can be manipulated, and is characterized by a diametrically disposed arm 20 extending over the turning axis a to carry a holder H for chips and cards moved into position for easy access to any one of a number of players seated around the game table. The swivel member S is provided to be free to revolve against a uniform frictional resistance supported upon the support bearing face 12, and to this end it has a supported hub 21 complementary to the supporting hub 11, and it is concentric with the axis a. Support of the swivel member S is by means of a downwardly faced horizontal rim 22 complementary to the upwardly faced peripheral portion of the support bearing face 12, there being a depending skirt 23 clear of and enclosing the upstanding cylinder wall 14. The rim 22 is of restricted radial dimension whereby frictional contact is reduced and the drag coefficient is predictably controlled. Although clearance is shown, the rim 22 rests concentrically upon the support bearing face 12 with substantially flat interface engagement only at the side thereof which is depressed, and usually the weighted side where the arm 20 carries the holder H.

In accordance with this invention, the supported hub 21 is drawn toward the supporting hub 11 and into an adjusted position against the top thrust washer 18 that holds the rim 22 slightly spaced from bearing face 12 only when the opposing faces thereof are parallel. In practice however, weight applied by the holder H depresses the rim 22 at one side for frictional engagement over a limited peripheral interface area. As shown, the fastener means F involves a draw screw 25 that pulls the hubs 11 and 21 into engagement with slight clearance of its head from a bottom thrust washer 19, while a bearing face 27 of the supported hub 22 rests upon the first mentioned top thrust washer 18. In practice, a closure plug 28 conceals the screw head after initial adjustment, so that the assembly is essentially tamper-proof. The washers 18 and 19 are anti-friction washers made of Teflon or Nylon as manufactured by DuPont, a waxy plastic material having a low coefficient of friction when interfaced with the hard smooth surface of polystyrene plastic.

A uniformly predictable drag and braking action is established by molding the base member B and swivel member S of a relatively hard and durable plastic material. The supporting base member B and rotatable swivel member S are preferably made of a crystal clear high impact polystyrene, or the like. Accordingly, the plastic material of the two members affords a slding action between rim 22 and supporting bearing face 12 and having a braking action coupled with ease of turning as circumstances require.

The holder H is a radial extension of the swivel arm 20 and is comprised of an inner ramp 30 for supporting a deck of playing cards ready to be drawn from, and an outer chip pocket 31 for receiving a stack of chips to be taken by the players.

The ramp 30 is planar and extends upwardly from the horizontal top face 32 of the swivel arm 20, and it is transversely horizontal. The angle of inclination is as much as 52°, so that a deck of cards is biased, as shown, for easy access of individual cards when resting in place against the incline thereof. As shown, there are spaced parallel rails 33 at either side of the swivel arm 20, to position the cards in alignment as a deck.

The outer chip pocket 31 is of open-topped configuration, having a transversely disposed semicircular bottom 34 and spaced vertically disposed end walls 35 holding the chips used in the game. As shown, the chips are round and are readily accessible at the top opening of the pocket 31.

Figure 7:
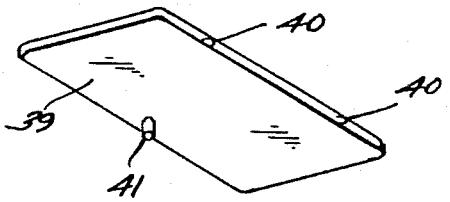
FIG. 7 is a perspective view of said closure.

The diametrically opposite end of arm 20, from the holder H, is of a length substantially equal to the holder H from axis a, its purpose being access as a lever for manipulating the swivel arm 20. Accordingly, a player opposite or at a side of the existent player position of the holder H can manipulate the arm so as to turn it into a subsequent position as may be required. The outer portion 36 of arm 20 is recessed at 37, at its underside, for reception of a card 38 bearing an identification such as a monogram or the like printed thereon and visible through the transparent material forming the swivel arm. In practice, a closure 39 is received in and occupies the recess at 37, so as to retain the card 38 secure. The closure is best illustrated in FIG. 7, showing a pair of spaced slight projections 40 along one edge, so as to establish frictional engagement for retainment, there being a small peg 41 projecting from the bottom face of the closure at the opposite edge for gripped engagement by a pliers or the like for withdrawal if and when required.

At the holder H manual accessibility is increased by provision of the means or extension E that projects laterally from the swivel arm 20 at the juncture of the ramp 30 and pocket 31. The extension E is a round rod member 42 substantially equal in length to the length of swivel arm 20, including the holder H, and it slides through lateral openings 43 aligned through the side walls 35' that support the ramp 30 and brace it to the pocket 31. A friction means 44 engages the rod member 42 to hold it positioned, shown as a resilient post depending from the interior of the holder H and with its free end interfering with a side of the extension rod member 42, midway of its bearing engagement through the openings 38. In practice, the resilient post of means 44 engages in a detent 45 at one side of the rod member 42, the detent being located at the center and forward side of the rod member, toward the holder H. Release of the detent is facilitated by turning the rod member, and to this end its rotative position is indicated by a flattened portion 46 at the end or ends of said rod member. The flat 47 of end portions 45 is in the same plane as the detent 45, at the forward side of the rod member 42. Thus, the extension is readily assembled and disassembled as circumstances require.

From the foregoing it will be seen that an extremely practical swivel dispenser is provided for diseminating cards as they are required for conducting a game. A feature is the initial adjustment for smooth operation with predictable frictional characteristics that enables the players to deftly position the swivel arm and supported deck of cards and stack of chips, thereby avoiding the inconvenience of reaching uncomfortable distances.

Having described only the typical preferred form and application of my invention, I do not wish to be limited or restricted to the specific details herein set forth, but wish to reserve to myself any modifications or variations that may appear to those skilled in the art as set forth within the limits of the following claims.

I claim:

1. A swivel dispenser for game boards, wherein a platform in the form of a swivel arm extending diametrically of a turning axis has a card holder at one end for player access, and is rotatable upon a supporting base assembled therewith, and including;

a supporting hub centered on the base, and an upwardly disposed support bearing face of circular form surrounding the supporting hub, and all of which is carried by a supporting flange having interface engagement with a supporting surface, a supported hub centered on the swivel arm and engaged upon the supporting hub of the base, and a downwardly disposed rim surrounding the supported hub, and a fastener means normally securing the supporting hub to the supported hub with slight clearance for free turning of the hubs relative to each other and allowing said downwardly disposed rim to bear at a restricted peripheral area upon said support bearing face when the holder is weighted with cards.

2. The swivel dispenser for game boards as set forth in claim 1, wherein the rim surrounding the supported hub on the swivel arm is of limited radial dimension to have restricted bearing engagement upon the peripheral portion of the support bearing face of the base.

3. The swivel dispenser for game boards as set forth in claim 1, wherein an anti friction washer is disposed between the supported hub engaged upon the supported hub.

4. The swivel dispenser for game boards as set forth in claim 1, wherein an anti friction washer of Teflon is disposed between the supporting hub engaged upon the supported hub.

5. The swivel dispenser for game boards as set forth in claim 1, wherein an anti friction washer of Nylon is disposed between the supporting hub engaged upon the supported hub.

6. The swivel dispenser for game boards as set forth in claim 1, wherein the fastener means is a headed screw fastener.

7. The swivel dispenser for game boards as set forth in claim 1, wherein the fastener means is a headed screw fastener with an anti friction washer disposed between a supporting bulkhead of the supporting hub and head of said screw fastener.

8. The swivel dispenser for game boards as set forth in claim 1, wherein the fastener means is a headed screw fastener with an anti friction washer of Teflon disposed between a supporting bulkhead of the supporting hub and head of said screw fastener.

9. The swivel dispenser for game boards as set forth in claim 1, wherein the fastener means is a headed screw fastener with an anti friction washer of Nylon disposed between a supporting bulkhead of the supporting hub and head of said screw fastener.

10. The swivel dispenser for game boards as set forth in claim 1, wherein the fastener means is a headed screw fastener with an anti friction washer disposed between a supporting bulkhead of the supporting hub and head of said screw fastener, and wherein an anti friction washer is disposed between the supporting hub engaged upon the supported hub.

11. The swivel dispenser for game boards as set forth in claim 1, wherein the fastener means is a headed screw fastener with an anti friction washer of Teflon disposed between a supporting bulkhead of the supporting hub and head of said screw fastener, and wherein an anti friction washer of Teflon is disposed between the supporting hub engaged upon the supported hub.

12. The swivel dispenser for game boards as set forth in claim 1, wherein the fastener means is a headed screw fastener with an anti friction washer of Nylon disposed between a supporting bulkhead of the supporting hub and head of said screw fastener, and wherein an anti friction washer of Nylon is disposed between the supporting hub engaged upon the supported hub.

13. The swivel dispenser for game boards as set forth in claim 1, wherein the fastener means is a headed screw fastener, the headed screw fastener being received in a chamber in the base and inaccessible by means of a plug inserted in and closing said chamber.

14. A swivel dispenser for game boards, wherein a platform in the form of a swivel arm extending diametrically of a turning axis has a card holder at one end and with a removable extension member for player access, and is rotatable upon a supporting base assembled therewith, and including;

a supporting hub centered on the base, and all of which is carried by a supporting flange having interface engagement with a supporting surface, A supported hub centered on the swivel arm and engaged to rotate upon the supporting hub of the base, and a pair of side openings in the card holder for slideable entry and transverse passage therethrough of the removable extension member, the extension member being of uniform cross section and adjustably extensible laterally from opposite sides of the card holder for manual engagement.

15. The swivel dispenser for game boards as set forth in claim 14, wherein the elongated extension member is frictionally held positioned by means in the card holder.

16. The swivel dispenser for game boards as set forth in claim 14, wherein the elongated extension member is positioned by a resilient post biased thereto within the card holder.

17. The swivel dispenser for game boards as set forth in claim 14, wherein the elongated extension member is of round cross section positioned by a resilient post biased into a notch therein and rotatable for release.

* * * * *